US011387576B1

(12) United States Patent
Chen et al.

(10) Patent No.: US 11,387,576 B1
(45) Date of Patent: Jul. 12, 2022

(54) ANTENNA SYSTEM

(71) Applicant: Wistron Corp., New Taipei (TW)

(72) Inventors: Chien Hsun Chen, New Taipei (TW); Cheng-Chieh Yang, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 17/167,419

(22) Filed: Feb. 4, 2021

(30) Foreign Application Priority Data

Dec. 29, 2020 (TW) ..... 109146593

(51) Int. Cl.

| | |
|---|---|
| ***H01Q 1/24*** | (2006.01) |
| ***H01Q 25/00*** | (2006.01) |
| ***H01Q 9/42*** | (2006.01) |
| ***H01Q 5/35*** | (2015.01) |

(52) U.S. Cl.
CPC ..... *H01Q 25/00* (2013.01); *H01Q 1/243* (2013.01); *H01Q 5/35* (2015.01); *H01Q 9/42* (2013.01)

(58) Field of Classification Search
CPC ..... H01Q 25/00; H01Q 5/35; H01Q 1/243; H01Q 9/42
See application file for complete search history.

(56) References Cited

U.S. PATENT DOCUMENTS

| | | | |
|---|---|---|---|
| 9,300,055 B2 * | 3/2016 | Tseng | H01Q 1/243 |
| 10,784,562 B2 | 9/2020 | Kim et al. | |

FOREIGN PATENT DOCUMENTS

| | | |
|---|---|---|
| CN | 206116614 U | 4/2017 |
| TW | I549353 B | 9/2016 |
| TW | I694638 B | 5/2020 |

OTHER PUBLICATIONS

Chinese language office action dated Apr. 29, 2021, issued in application No. TW 109146593.
Chinese Language Office Action dated Jun. 24, 2021 in corresponding Taiwan application 109146593.
CTIA Everything Wireless "Test Plan for 2×2 Downlink MIMO and Transmit Diversity Over-the-Air Performance;" Sep. 2017; pp. 1-84.

* cited by examiner

*Primary Examiner* — Graham P Smith
(74) *Attorney, Agent, or Firm* — McClure, Qualey & Rodack, LLP

(57) ABSTRACT

An antenna system includes a first antenna element, a second antenna element, and a circuit region. The first antenna element includes a first nonconductive support element and a first main radiation element. The first main radiation element is disposed on the first nonconductive support element. The second antenna element includes a second nonconductive support element and a second main radiation element. The second main radiation element is disposed on the second nonconductive support element. The second main radiation element is at least partially perpendicular to the first main radiation element. The circuit region is positioned between the first antenna element and the second antenna element.

19 Claims, 5 Drawing Sheets

ANTENNA SYSTEM

CROSS REFERENCE TO RELATED APPLICATIONS

This application claims priority of Taiwan Patent Application No. 109146593 filed on Dec. 29, 2020, the entirety of which is incorporated by reference herein.

BACKGROUND OF THE INVENTION

Field of the Invention

The disclosure generally relates to an antenna system, and more particularly, it relates to an almost omnidirectional antenna system.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has a radiation pattern with any null, it will negatively affect the communication quality of the mobile device. Accordingly, it has become a critical challenge for antenna designers to design an almost omnidirectional antenna system.

BRIEF SUMMARY OF THE INVENTION

In an exemplary embodiment, the disclosure is directed to an antenna system that includes a first antenna element, a second antenna element, and a circuit region. The first antenna element includes a first nonconductive support element and a first main radiation element. The first main radiation element is disposed on the first nonconductive support element. The second antenna element includes a second nonconductive support element and a second main radiation element. The second main radiation element is disposed on the second nonconductive support element. The second main radiation element is at least partially perpendicular to the first main radiation element. The circuit region is positioned between the first antenna element and the second antenna element.

In some embodiments, the first antenna element and the second antenna element cover a first frequency band, a second frequency band, and a third frequency band. The first frequency band is from 699 MHz to 960 MHz. The second frequency band is from 1710 MHz to 2200 MHz. The third frequency band is from 2300 MHz to 2690 MHz.

In some embodiments, the second frequency band includes a first frequency interval, a second frequency interval, and a third frequency interval. The first frequency interval is from 1710 MHz to 1800 MHz. The second frequency interval is from 1800 MHz to 2000 MHz. The third frequency interval is from 2000 MHz to 2200 MHz.

In some embodiments, the first antenna element further includes a first feeding radiation element, a first radiation element, a shorting element, a second radiation element, a third radiation element, and a fourth radiation element. The first feeding radiation element has a first feeding point. The first main radiation element is coupled to the first feeding radiation element. The first radiation element is coupled to the first feeding radiation element. The first radiation element is coupled through the shorting element to a ground voltage. The second radiation element is coupled to the first feeding radiation element. The third radiation element is coupled to the first feeding point. The fourth radiation element is coupled to the ground voltage. The fourth radiation element is adjacent to the third radiation element. The first feeding radiation element, the first radiation element, the shorting element, the second radiation element, the third radiation element, and the fourth radiation element are disposed on the first nonconductive support element.

In some embodiments, the first main radiation element further includes a terminal U-shaped bending portion.

In some embodiments, the total length of the first feeding radiation element and the first main radiation element is shorter than or equal to 0.25 wavelength of the first frequency band.

In some embodiments, the first radiation element has a variable-width meandering shape.

In some embodiments, each of the second radiation element, the third radiation element, and the fourth radiation element substantially has an L-shape.

In some embodiments, the length of the first radiation element is shorter than or equal to 0.25 wavelength of the first frequency interval.

In some embodiments, the total length of the first feeding radiation element and the second radiation element is shorter than or equal to 0.25 wavelength of the second frequency interval.

In some embodiments, the length of the third radiation element is shorter than or equal to 0.25 wavelength of the third frequency interval.

In some embodiments, the length of the fourth radiation element is shorter than or equal to 0.25 wavelength of the third frequency band.

In some embodiments, the first antenna element further includes a first matching element and a second matching element. The first matching element and the second matching element are coupled to the first radiation element, and substantially extend away from each other. The first matching element and the second matching element are disposed on the first nonconductive support element.

In some embodiments, second antenna element further includes a second feeding radiation element, a fifth radiation element, a sixth radiation element, a seventh radiation element, and an eighth radiation element. The second feeding radiation element has a second feeding point. The second main radiation element is coupled through the fifth radiation element to the second feeding radiation element. The fifth radiation element is coupled through the sixth radiation element to the ground voltage. The seventh radiation element is coupled to the second feeding radiation element. The eighth radiation element is coupled to the ground voltage. The second feeding radiation element, the fifth radiation element, the sixth radiation element, the seventh radiation element, and the eighth radiation element are disposed on the second nonconductive support element.

In some embodiments, the fifth radiation element and the second feeding radiation element are substantially perpendicular to each other.

In some embodiments, the total length of the second feeding radiation element, the fifth radiation element, and the second main radiation element is shorter than or equal to 0.25 wavelength of the first frequency band.

In some embodiments, each of the sixth radiation element, the seventh radiation element, and the eighth radiation element substantially has an L-shape.

In some embodiments, the total length of the second feeding radiation element, the fifth radiation element, and the sixth radiation element is shorter than or equal to 0.5 wavelength of the first frequency interval.

In some embodiments, the total length of the second feeding radiation element and the seventh radiation element is shorter than or equal to 0.25 wavelength of the second frequency interval or the third frequency interval.

In some embodiments, the length of the eighth radiation element is shorter than or equal to 0.25 wavelength of the third frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
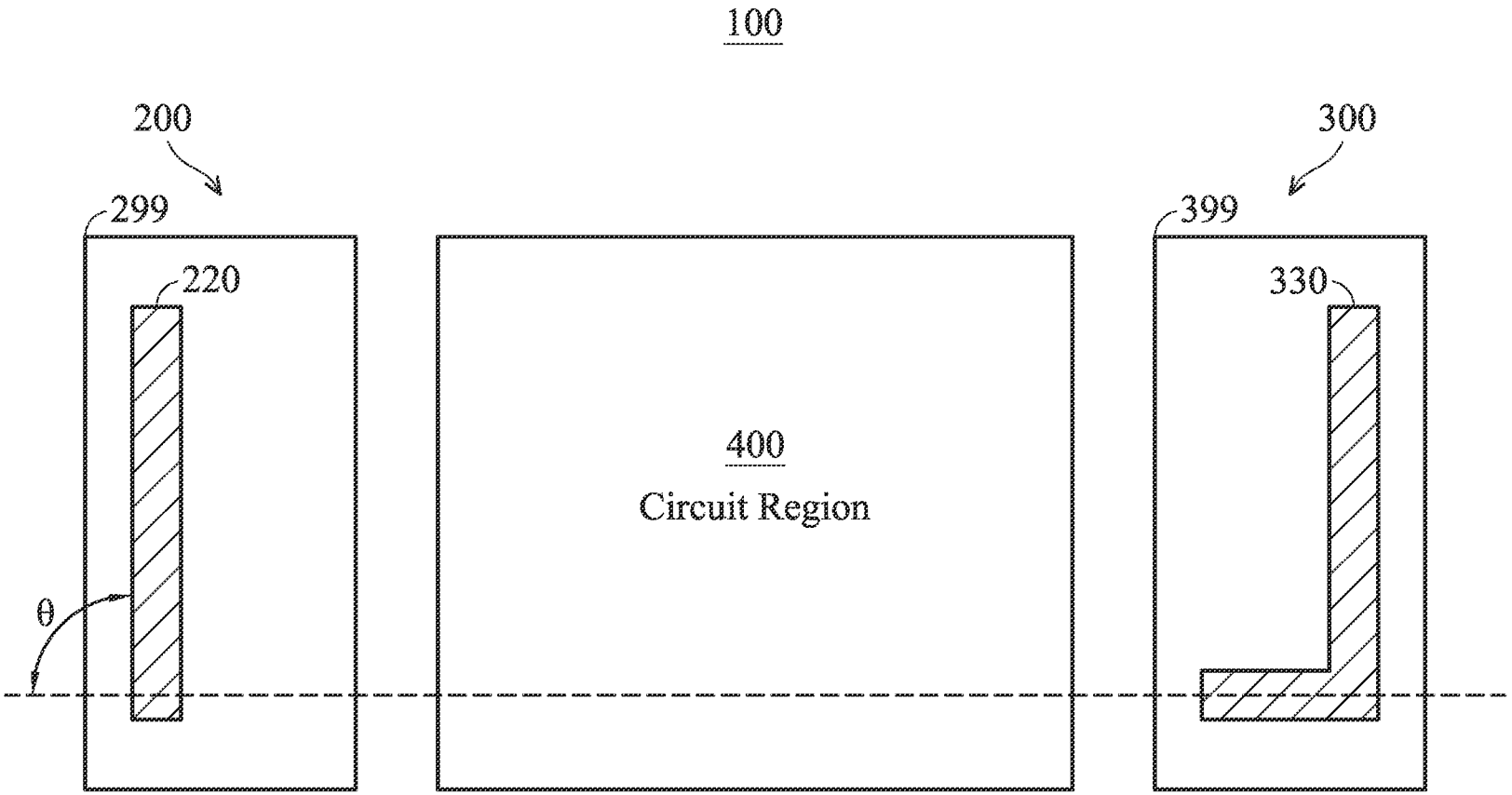
FIG. 1 is a diagram of an antenna system according to an embodiment of the invention.

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element or feature as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a diagram of an antenna system 100 according to an embodiment of the invention. The antenna system 100 may be applied to a mobile device, such as a phone, a tablet computer, or a notebook computer. As shown in FIG. 1, the antenna system 100 includes a first antenna element 200, a second antenna element 300, and a circuit region 400. The first antenna element 200 includes a first main radiation element 220 and a first nonconductive support element 299. The first main radiation element 220 is disposed on the first nonconductive support element 299. The second antenna element 300 includes a second main radiation element 330 and a second nonconductive support element 399. The second main radiation element 330 is disposed on the second nonconductive support element 399. The shapes of the first main radiation element 220 and the second main radiation element 330 are not limited in the invention, and they may both be made of metal materials, such as silver, copper, aluminum, iron, or their alloys. The circuit region 400 is positioned between the first antenna element 200 and the second antenna element 300. The circuit region 400 may be coupled to a system ground plane (not shown). The circuit region 400 can accommodate one or more circuit components, such as a processor, a memory device, and/or a battery, although they are not displayed in FIG. 1. It should be noted that the second main radiation element 330 of the second antenna element 300 is at least partially perpendicular to the first main radiation element 220 of the first antenna element 200. For example, the angle θ between a portion of the second main radiation element 330 and the first main radiation element 220 may be from 45 to 135 degrees, or may be from 60 to 120 degrees, such as about 90 degrees. According to practical measurements, such an at least partially orthogonal design can effectively suppress all of the nulls of the antenna system 100, and therefore the antenna system 100 can provide an almost omnidirectional radiation pattern.

In some embodiments, both the first antenna element 200 and the second antenna element 300 of the antenna system 100 can cover a first frequency band, a second frequency band, and a third frequency band. For example, the first frequency band may be from 699 MHz to 960 MHz, the second frequency band may be from 1710 MHz to 2200 MHz, and the third frequency band may be from 2300 MHz to 2690 MHz. Specifically, the second frequency band may include a first frequency interval from 1710 MHz to 1800 MHz, a second frequency interval from 1800 MHz to 2000 MHz, and a third frequency interval from 2000 MHz to 2200 MHz. Therefore, the antenna system 100 can support at least the wideband operations of LTE (Long Term Evolution) and the next 5G (5th Generation Wireless System) communication.

The following embodiments will introduce the detail structures of the first antenna element 200 and the second antenna element 300. It should be understood that these figures and descriptions are merely exemplary, rather than limitations of the invention.

Figure 2:
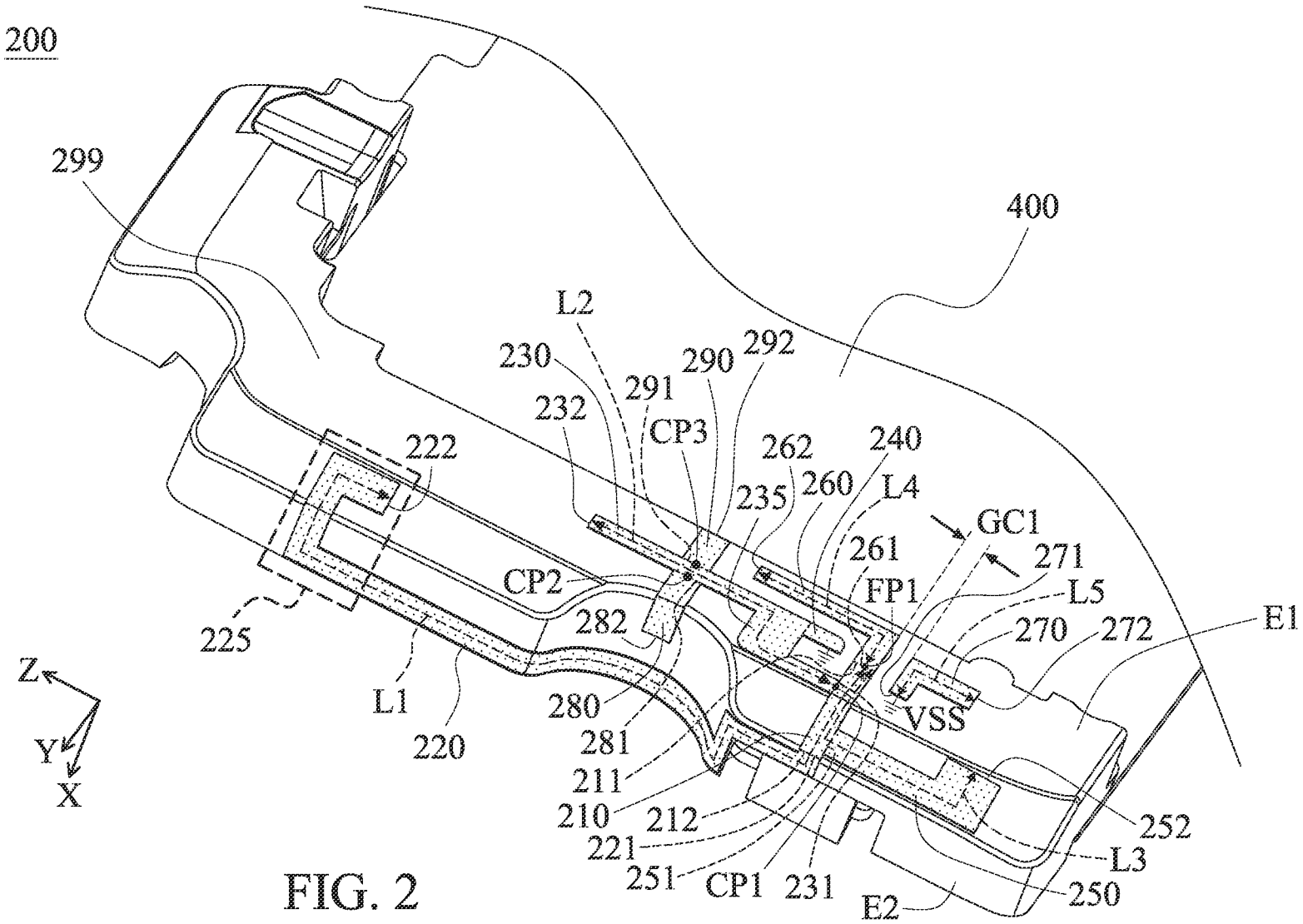
FIG. 2 is a perspective view of a first antenna element according to an embodiment of the invention.

FIG. 2 is a perspective view of the first antenna element 200 according to an embodiment of the invention. In the embodiment of FIG. 2, the first antenna element 200 includes a first feeding radiation element 210, a first main radiation element 220, a first radiation element 230, a shorting element 240, a second radiation element 250, a third radiation element 260, a fourth radiation element 270, and a first nonconductive support element 299. The first feeding radiation element 210, the first main radiation element 220, the first radiation element 230, the shorting element 240, the second radiation element 250, the third radiation element 260, and the fourth radiation element 270 may all be made of metal materials, and they may all be disposed on the first nonconductive support element 299. In addition, the first nonconductive support element 299 has a first surface E1 and a second surface E2 which are substantially perpendicular to each other.

The first feeding radiation element 210 may substantially have a straight-line shape, which may be positioned on the first surface E1 of the first nonconductive support element 299. Specifically, the first feeding radiation element 210 has a first end 211 and a second end 212. A first feeding point FP1 is positioned at the first end 211 of the first feeding radiation element 210. The first feeding point FP1 may be further coupled to a signal source (not shown). For example, the signal source may be an RF (Radio Frequency) module for exciting both the first antenna element 200 and the second antenna element 300.

The first main radiation element 220 may substantially have a meandering shape, which may extend from the second surface E2 onto the first surface E1 of the first nonconductive support element 299. Specifically, the first main radiation element 220 has a first end 221 and a second end 222. The first end 221 of the first main radiation element 220 is coupled to the second end 212 of the first feeding radiation element 210. The second end 222 of the first main radiation element 220 is an open end. In some embodiments, the first main radiation element 220 further includes a terminal U-shaped bending portion 225, which is adjacent to the second end 222 of the first main radiation element 220. It should be noted that the term "adjacent" or "close" over the disclosure means that the distance (spacing) between two corresponding elements is shorter than a predetermined distance (e.g., 5 mm or shorter), or means that the two corresponding elements are touching each other directly (i.e., the aforementioned distance/spacing therebetween is reduced to 0).

The first radiation element 230 may substantially have a variable-width meandering shape (with a widening portion 235), which may be positioned on the first surface E1 of the first nonconductive support element 299. Specifically, the first radiation element 230 has a first end 231 and a second end 232. The first end 231 of the first radiation element 230 is coupled to a first connection point CP1 on the first feeding radiation element 210. The second end 232 of the first radiation element 230 is an open end.

The shorting element 240 may substantially have a straight-line shape, which may be positioned on the first surface E1 of the first nonconductive support element 299. The widening portion 235 of the first radiation element 230 is coupled through the shorting element 240 to a ground voltage VSS (e.g., 0V).

The second radiation element 250 may substantially have an L-shape, which may be positioned on the first surface E1 of the first nonconductive support element 299. Specifically, the second radiation element 250 has a first end 251 and a second end 252. The first end 251 of the second radiation element 250 is coupled to the second end 212 of the first feeding radiation element 210. The second end 252 of the second radiation element 250 is an open end.

The third radiation element 260 may substantially have an L-shape, which may be positioned on the first surface E1 of the first nonconductive support element 299. Specifically, the third radiation element 260 has a first end 261 and a second end 262. The first end 261 of the third radiation element 260 is coupled to the first feeding point FP1. The second end 262 of the third radiation element 260 is an open end. For example, the second end 262 of the third radiation element 260 and the second end 232 of the first radiation element 230 may extend in the same direction.

The fourth radiation element 270 may substantially have an L-shape, which may be positioned on the first surface E1 of the first nonconductive support element 299. Specifically, the fourth radiation element 270 has a first end 271 and a second end 272. The first end 271 of the fourth radiation element 270 is coupled to the ground voltage VSS. The second end 272 of the fourth radiation element 270 is an open end. For example, the second end 272 of the fourth radiation element 270 and the second end 262 of the third radiation element 260 may extend in opposite directions and away from each other. The fourth radiation element 270 is adjacent to but separate from the third radiation element 260. A coupling gap GC1 may be formed between the fourth radiation element 270 and the third radiation element 260.

In some embodiments, the first antenna element 200 further includes a first matching element 280 and a second matching element 290, which may both be made of metal materials. The first matching element 280 may substantially have a bending straight-line shape, which may extend from the first surface E1 onto the second surface E2 of the first nonconductive support element 299. Specifically, the first matching element 280 has a first end 281 and a second end 282. The first end 281 of the first matching element 280 is coupled to a second connection point CP2 on the first radiation element 230. The second end 282 of the first matching element 280 is an open end. The second matching element 290 may substantially have a straight-line shape, which may be positioned on the first surface E1 of the first nonconductive support element 299. Specifically, the second matching element 290 has a first end 291 and a second end 292. The first end 291 of the second matching element 290 is coupled to a third connection point CP3 on the first radiation element 230. The second end 292 of the second matching element 290 is an open end. For example, the second end 292 of the second matching element 290 and the second end 282 of the first matching element 280 may extend away from each other. In addition, a crisscross shape may be formed by the first radiation element 230, the first matching element 280, and the second matching element 290. It should be understood that the first matching element 280 and the second matching element 290 are optional components, which are removable in other embodiments.

With respect to the antenna theory of the first antenna element 200, the first feeding radiation element 210 and the first main radiation element 220 are excited to generate the aforementioned first frequency band. The first feeding radiation element 210, the first radiation element 230, the second radiation element 250, and the third radiation element 260 are excited to generate the aforementioned second frequency band. The fourth radiation element 270 is excited to generate the aforementioned third frequency band. Furthermore, the incorporations of the shorting element 240, the first matching element 280, and the second matching element 290 can help to fine-tune the impedance matching of the first antenna element 200.

In some embodiments, the element sizes of the first antenna element 200 are described as follows. The total length L1 of the first feeding radiation element 210 and the first main radiation element 220 may be shorter than or equal to 0.25 wavelength (λ/4) of the first frequency band of the antenna system 100. The length L2 of the first radiation element 230 may be shorter than or equal to 0.25 wavelength (λ/4) of the first frequency interval of the antenna system 100. The total length L3 of the first feeding radiation element 210 and the second radiation element 250 may be shorter than or equal to 0.25 wavelength (λ/4) of the second frequency interval of the antenna system 100. The length L4 of the third radiation element 260 may be shorter than or equal to 0.25 wavelength (λ/4) of the third frequency interval of the antenna system 100. The length L5 of the fourth radiation element 270 may be shorter than or equal to 0.25 wavelength (λ/4) of the third frequency band of the antenna system 100. The width of the coupling gap GC1 may be shorter than 4 mm. The above ranges of element sizes and element parameters are calculated and obtained according to many experiment results, and they help to optimize the operation bandwidth and the impedance matching of the first antenna element 200.

Figure 3:
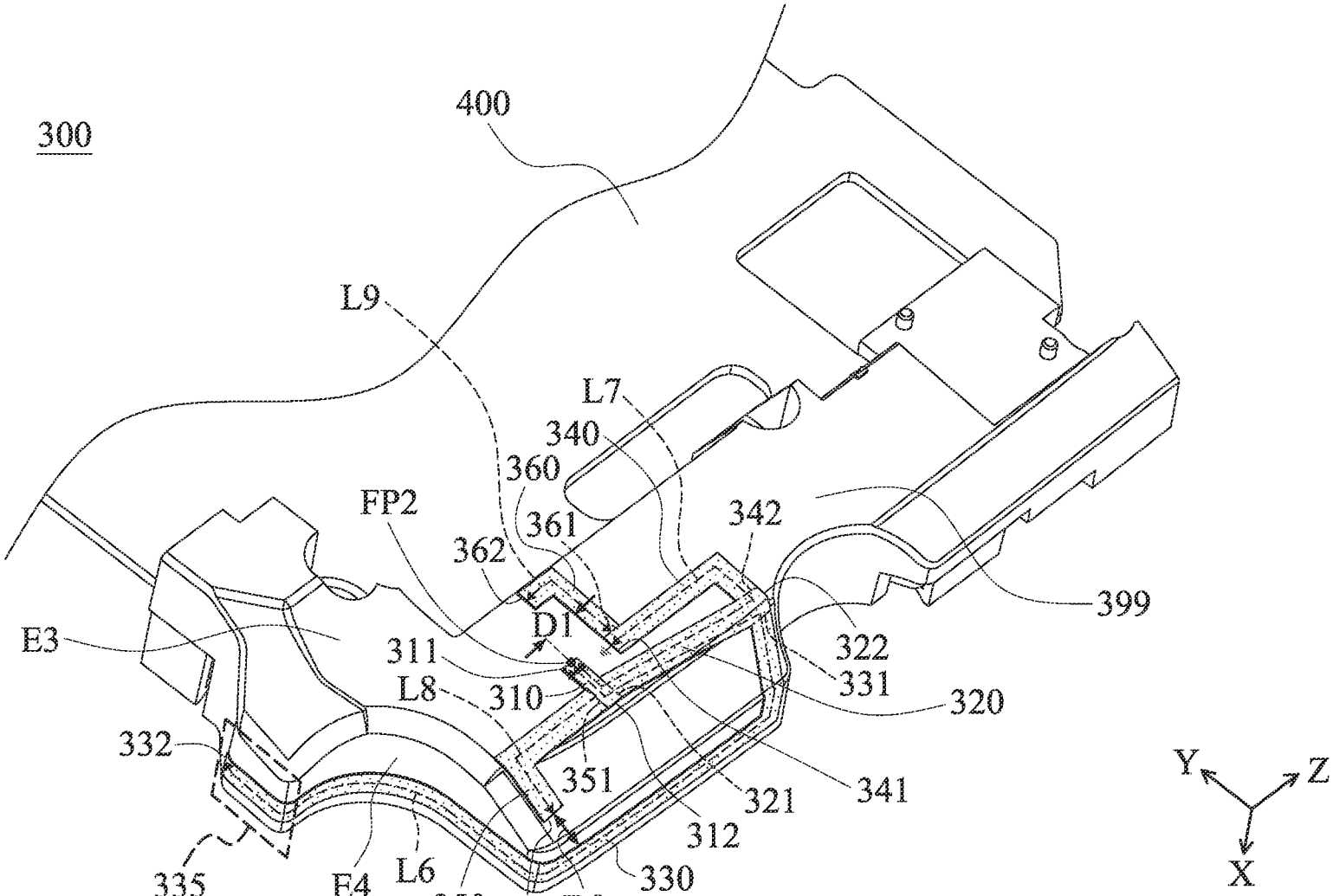
FIG. 3 is a perspective view of a second antenna element according to an embodiment of the invention.

FIG. 3 is a perspective view of the second antenna element 300 according to an embodiment of the invention. In the embodiment of FIG. 3, the second antenna element 300 includes a second feeding radiation element 310, a fifth radiation element 320, a second main radiation element 330, a sixth radiation element 340, a seventh radiation element 350, an eighth radiation element 360, and a second nonconductive support element 399. The second feeding radiation element 310, the fifth radiation element 320, the second main radiation element 330, the sixth radiation element 340, the seventh radiation element 350, and the eighth radiation element 360 may all be made of metal materials, and they may all be disposed on the second nonconductive support element 399. In addition, the second nonconductive support element 399 has a third surface E3 and a fourth surface E4 which are substantially perpendicular to each other.

The second feeding radiation element 310 may substantially have a straight-line shape, which may be positioned on the third surface E3 of the second nonconductive support element 399. Specifically, the second feeding radiation element 310 has a first end 311 and a second end 312. A second feeding point FP2 is positioned at the first end 311 of the second feeding radiation element 310. The second feeding point FP2 may be further coupled to the aforementioned signal source.

The fifth radiation element 320 may substantially have a straight-line shape, which may be positioned on the third surface E3 of the second nonconductive support element 399. The fifth radiation element 320 may be substantially perpendicular to the second feeding radiation element 310. Specifically, the fifth radiation element 320 has a first end 321 and a second end 322. The first end 321 of the fifth radiation element 320 is coupled to the second end 312 of the second feeding radiation element 310.

The second main radiation element 330 may substantially has a meandering shape, which may extend from the third surface E3 onto the fourth surface E4 of the second nonconductive support element 399. Specifically, the second main radiation element 330 has a first end 331 and a second end 332. The first end 331 of the second main radiation element 330 is coupled to the second end 322 of the fifth radiation element 320. The second end 332 of the second main radiation element 330 is an open end. That is, the second main radiation element 330 is coupled through the fifth radiation element 320 to the second feeding radiation element 310. In some embodiments, the second main radiation element 330 further includes a terminal extension bending portion 335, which is adjacent to the second end 332 of the second main radiation element 330. The terminal extension bending portion 335 of the second main radiation element 330 may be substantially perpendicular to the aforementioned first main radiation element 220. In some embodiments, the angle between the terminal extension bending portion 335 of the second main radiation element 330 and the first main radiation element 220 may be from 45 to 135 degrees, or may be from 60 to 120 degrees, such as about 90 degrees.

The sixth radiation element 340 may substantially have an L-shape, which may be positioned on the third surface E3 of the second nonconductive support element 399. Specifically, the sixth radiation element 340 has a first end 341 and a second end 342. The first end 341 of the sixth radiation element 340 is coupled to the ground voltage VSS. The second end 342 of the sixth radiation element 340 is coupled to the second end 322 of the fifth radiation element 320. That is, the fifth radiation element 320 is coupled through the sixth radiation element 340 to the ground voltage VSS. In some embodiments, the first end 341 of the sixth radiation element 340 is adjacent to the second feeding point FP2, such that a loop structure is almost formed by the second feeding radiation element 310, the fifth radiation element 320, and the sixth radiation element 340.

The seventh radiation element 350 may substantially have an L-shape, which may be positioned on the third surface E3 of the second nonconductive support element 399. Specifically, the seventh radiation element 350 has a first end 351 and a second end 352. The first end 351 of the seventh radiation element 350 is coupled to the second end 312 of the second feeding radiation element 310. The second end 352 of the seventh radiation element 350 is an open end. For example, the second end 352 of the seventh radiation element 350 may extend toward the second main radiation element 330.

The eighth radiation element 360 may substantially have an L-shape, which may be positioned on the third surface E3 of the second nonconductive support element 399. Specifically, the eighth radiation element 360 has a first end 361 and a second end 362. The first end 361 of the eighth radiation element 360 is coupled to the first end 341 of the sixth radiation element 340 and the ground voltage VSS. The second end 362 of the eighth radiation element 360 is an open end. For example, the second end 362 of the eighth radiation element 360 and the second end 352 of the seventh radiation element 350 may substantially extend in orthogonal directions.

With respect to the antenna theory of the second antenna element 300, the second feeding radiation element 310, the fifth radiation element 320, and the second main radiation element 330 are excited to generate the aforementioned first frequency band. The second feeding radiation element 310, the fifth radiation element 320, the sixth radiation element 340, and the seventh radiation element 350 are excited to generate the aforementioned second frequency band. The eighth radiation element 360 is excited to generate the aforementioned third frequency band.

In some embodiments, the element sizes of the second antenna element 300 are described as follows. The total length L6 of the second feeding radiation element 310, the fifth radiation element 320, and the second main radiation element 330 may be shorter than or equal to 0.25 wavelength ($\lambda/4$) of the first frequency band of the antenna system 100. The total length L7 of the second feeding radiation element 310, the fifth radiation element 320, and the sixth radiation element 340 may be shorter than or equal to 0.5 wavelength ($\lambda/2$) of the first frequency interval of the antenna system 100. The total length L8 of the second feeding radiation element 310 and the seventh radiation element 350 may be shorter than or equal to 0.25 wavelength ($\lambda/4$) of the second frequency interval or the third frequency interval of the antenna system 100. The length L9 of the eighth radiation element 360 may be shorter than or equal to 0.25 wavelength ($\lambda/4$) of the third frequency band of the antenna system 100. The distance D1 between the first end 341 of the sixth radiation element 340 and the second feeding point FP2 may be from 0.5 mm to 1.5 mm. The distance D2 between the second end 352 of the seventh radiation element 350 and the second main radiation element 330 may be from 3 mm to 4 mm. The above ranges of element sizes and element parameters are calculated and obtained according to many experiment results, and they help to optimize the operation bandwidth and the impedance matching of the second antenna element 300.

Figure 4:
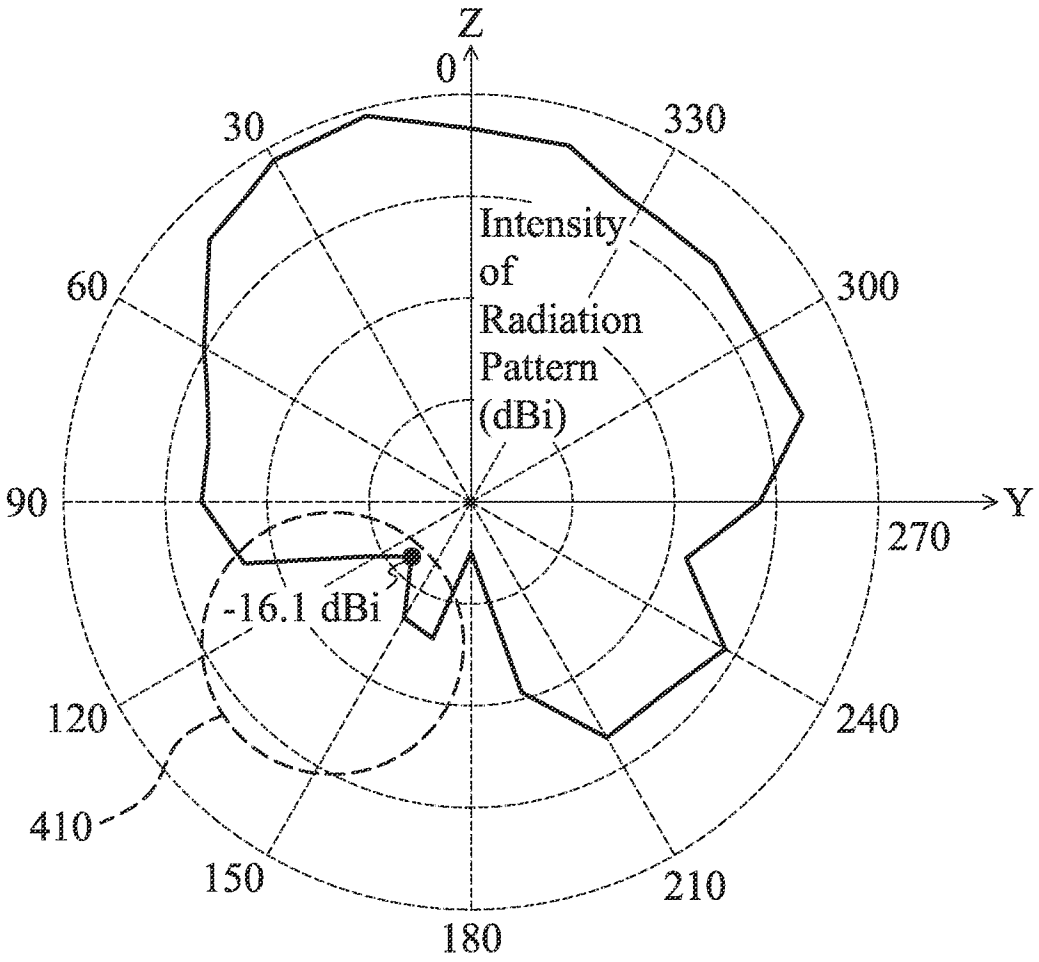
FIG. 4 is a radiation pattern of a conventional antenna system.

FIG. 4 is a radiation pattern of a conventional antenna system. As shown in FIG. 4, the radiation pattern of the conventional antenna system usually has a non-ideal null (indicated by a dash-line box 410), and thus the whole communication quality is degraded.

Figure 5:
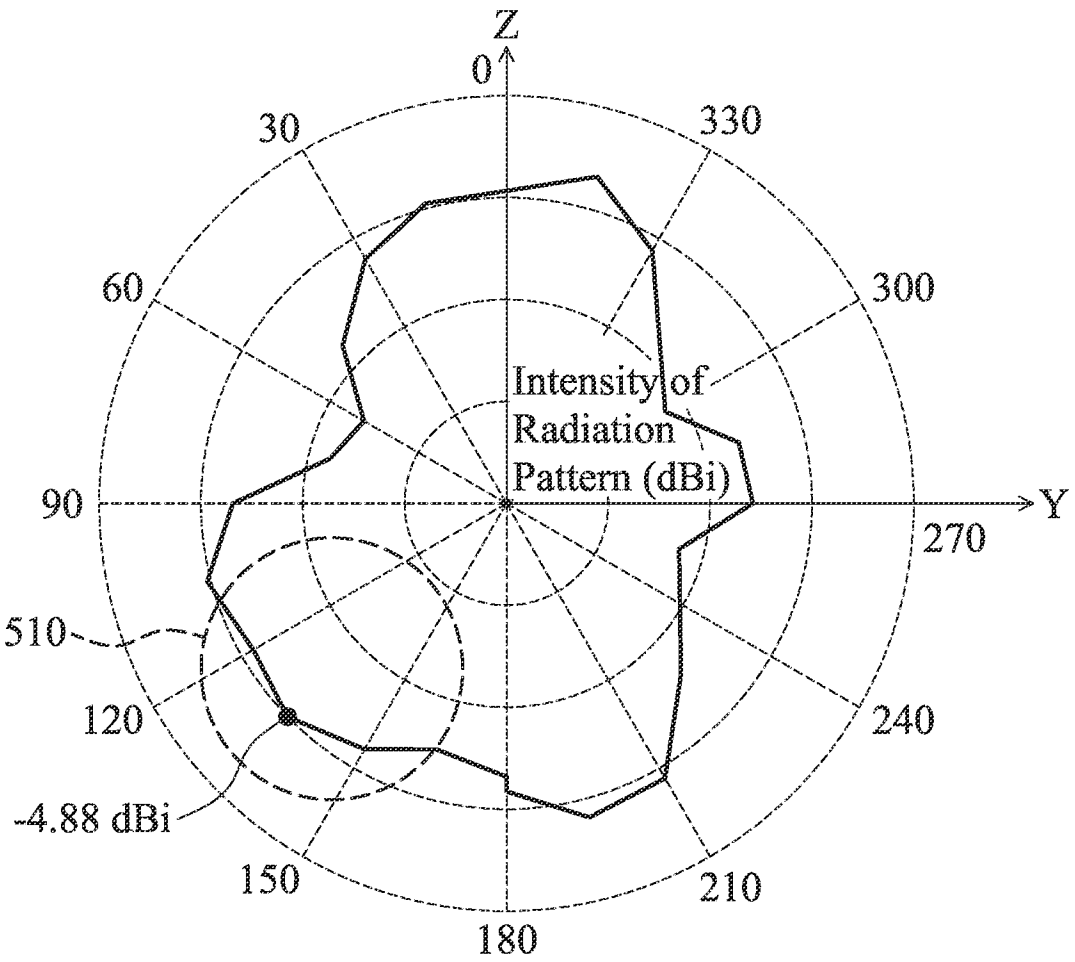
FIG. 5 is a radiation pattern of an antenna system according to an embodiment of the invention.

FIG. 5 is a radiation pattern of the antenna system 100 according to an embodiment of the invention. According to the measurement of FIG. 5, if the second main radiation element 330 of the second antenna element 300 is designed to be at least partially perpendicular to the first main radiation element 220 of the first antenna element 200, the null of the antenna system 100 will be effectively eliminated (indicated by a dash-line box 510). Therefore, the whole communication quality is significantly improved.

The invention proposes a novel antenna system. In comparison to the conventional technology, the proposed antenna system of the invention can almost eliminate all nulls and provide an almost omnidirectional radiation pattern, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna system of the invention is not limited to the configurations of FIGS. 1-5. The invention may merely include any one or more features of any one or more embodiments of FIGS. 1-5. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a first antenna element, comprising:

a first nonconductive support element; and a first main radiation element, disposed on the first nonconductive support element;

a second antenna element, comprising:

a second nonconductive support element; and a second main radiation element, disposed on the second nonconductive support element, wherein the second main radiation element is at least partially perpendicular to the first main radiation element; and a circuit region, positioned between the first antenna element and the second antenna element;

wherein the first antenna element and the second antenna element cover a first frequency band, a second frequency band, and a third frequency band, the first frequency band is from 699 MHz to 960 MHz, the second frequency band is from 1710 MHz to 2200 MHz, and the third frequency band is from 2300 MHz to 2690 MHz.

2. The antenna system as claimed in claim 1, wherein the second frequency band comprises a first frequency interval, a second frequency interval, and a third frequency interval, the first frequency interval is from 1710 MHz to 1800 MHz, the second frequency interval is from 1800 MHz to 2000 MHz, and the third frequency interval is from 2000 MHz to 2200 MHz.

3. The antenna system as claimed in claim 2, wherein the first antenna element further comprises:

a first feeding radiation element, having a first feeding point, wherein the first main radiation element is coupled to the first feeding radiation element;

a first radiation element, coupled to the first feeding radiation element;

a shorting element, wherein the first radiation element is coupled through the shorting element to a ground voltage;

a second radiation element, coupled to the first feeding radiation element;

a third radiation element, coupled to the first feeding point; and a fourth radiation element, coupled to the ground voltage, wherein the fourth radiation element is adjacent to the third radiation element;

wherein the first feeding radiation element, the first radiation element, the shorting element, the second radiation element, the third radiation element, and the fourth radiation element are disposed on the first nonconductive support element.

4. The antenna system as claimed in claim 3, wherein the first main radiation element further comprises a terminal U-shaped bending portion.

5. The antenna system as claimed in claim 3, wherein a total length of the first feeding radiation element and the first main radiation element is shorter than or equal to 0.25 wavelength of the first frequency band.

6. The antenna system as claimed in claim 3, wherein the first radiation element has a variable-width meandering shape.

7. The antenna system as claimed in claim 3, wherein each of the second radiation element, the third radiation element, and the fourth radiation element substantially has an L-shape.

8. The antenna system as claimed in claim 3, wherein a length of the first radiation element is shorter than or equal to 0.25 wavelength of the first frequency interval.

9. The antenna system as claimed in claim 3, wherein a total length of the first feeding radiation element and the second radiation element is shorter than or equal to 0.25 wavelength of the second frequency interval.

10. The antenna system as claimed in claim 3, wherein a length of the third radiation element is shorter than or equal to 0.25 wavelength of the third frequency interval.

11. The antenna system as claimed in claim 3, wherein a length of the fourth radiation element is shorter than or equal to 0.25 wavelength of the third frequency band.

12. The antenna system as claimed in claim 3, wherein the first antenna element further comprises:

a first matching element; and a second matching element, wherein the first matching element and the second matching element are coupled to the first radiation element, and substantially extend away from each other;

wherein the first matching element and the second matching element are disposed on the first nonconductive support element.

13. The antenna system as claimed in claim 3, wherein the second antenna element further comprises:

a second feeding radiation element, having a second feeding point;

a fifth radiation element, wherein the second main radiation element is coupled through the fifth radiation element to the second feeding radiation element;

a sixth radiation element, wherein the fifth radiation element is coupled through the sixth radiation element to the ground voltage;

a seventh radiation element, coupled to the second feeding radiation element; and an eighth radiation element, coupled to the ground voltage;

wherein the second feeding radiation element, the fifth radiation element, the sixth radiation element, the seventh radiation element, and the eighth radiation element are disposed on the second nonconductive support element.

14. The antenna system as claimed in claim 13, wherein the fifth radiation element and the second feeding radiation element are substantially perpendicular to each other.

15. The antenna system as claimed in claim 13, wherein a total length of the second feeding radiation element, the fifth radiation element, and the second main radiation element is shorter than or equal to 0.25 wavelength of the first frequency band.

16. The antenna system as claimed in claim 13, wherein each of the sixth radiation element, the seventh radiation element, and the eighth radiation element substantially has an L-shape.

17. The antenna system as claimed in claim 13, wherein a total length of the second feeding radiation element, the fifth radiation element, and the sixth radiation element is shorter than or equal to 0.5 wavelength of the first frequency interval.

18. The antenna system as claimed in claim 13, wherein a total length of the second feeding radiation element and the seventh radiation element is shorter than or equal to 0.25 wavelength of the second frequency interval or the third frequency interval.

19. The antenna system as claimed in claim 13, wherein a length of the eighth radiation element is shorter than or equal to 0.25 wavelength of the third frequency band.

* * * * *